United States Patent [19]

Greiner et al.

[11] 4,369,953

[45] Jan. 25, 1983

[54] FENCE CONSTRUCTIONS AND IN FENCE ELEMENTS THEREFOR

[76] Inventors: Waldemar H. Greiner, 11 Harrisford St., Unit 55, Hamilton, Canada, L8K 6L7; Denis P. Muscat-Tyler, 5134 Mulberry Dr., Burlington, Canada, L7L 3P4

[21] Appl. No.: 238,897

[22] Filed: Feb. 27, 1981

[30] Foreign Application Priority Data

Dec. 3, 1980 [CA] Canada ..... 366083

[51] Int. Cl.[3] ..... E04H 17/16; E04N 17/14

[52] U.S. Cl. ..... 256/24; 256/73; 256/59; 256/65

[58] Field of Search ..... 256/24, 23, 73, 21, 256/22, 59, 27, 60, 65

[56] References Cited

U.S. PATENT DOCUMENTS

| | | | |
|---|---|---|---|
| 2,809,017 | 10/1957 | Wong | 256/24 X |
| 2,919,113 | 12/1959 | Cofield | 256/21 |
| 3,136,530 | 6/1964 | Case | 256/24 |
| 3,290,014 | 12/1966 | Gtapleton | 256/73 |
| 3,698,692 | 10/1972 | Burrows | 256/24 X |
| 3,960,367 | 6/1976 | Rogers | 256/21 |
| 4,188,019 | 2/1980 | Merideth | 256/73 X |
| 4,306,631 | 12/1981 | Reusser | 256/24 X |

*Primary Examiner*—Richard J. Scanlan, Jr.
*Attorney, Agent, or Firm*—Hirons, Rogers & Scott

[57] ABSTRACT

The invention provides a new fence system permitting the construction of privacy fences; perimeter fences; boundary fences and rail fences using a small number of different fence elements. These elements consist of a hollow elongated post/rail element of semi-octagonal transverse cross-section; an end cap for the element when used as a post; an L-shaped connecting bracket; a panel element and an end cap therefor; a clip for fastening panel elements to the rails; closure elements for the rails and posts that also locate and hold the panels when they are engaged in slots therein. The panels are provided near to their center with a plurality of spaced stiffening walls to resist buckling under heavy loads.

31 Claims, 10 Drawing Figures

FENCE CONSTRUCTIONS AND IN FENCE ELEMENTS THEREFOR

FIELD OF THE INVENTION

The present invention is concerned with improvements in or relating to fence constructions, and in or relating to fence elements, such as fence panels for use in such constructions.

Review of the Prior Art

With the constant increase in the cost of wood suitable for fence constructions, and in the cost of maintenance of a wood fence once erected, there has been an accompanying increase in interest in fence constructions of other material, particularly metals and plastics and combinations thereof. For maximum utilisation of these other materials, which weight for weight are usually much more expensive than wood, they must use as little material as possible and be prefabricated as much as possible, so that erection on the site involves only the use of simple tools and assembly procedures. It is also of considerable commercial advantage to be able to erect a number of different kinds of fences; e.g. privacy screens and enclosures, perimeter fencing with vertical panels, and boundary fencing with horizontal rails, with or without horizontal panels, using only a small number of basic elements.

DEFINITION OF THE INVENTION

It is therefore an object of the invention to provide a new fence construction adaptable for the erection of a number of different kinds of fences.

It is another object to provide new fence elements adopted for such fence constructions.

In accordance with the present invention there is provided a post/rail element for a fence construction comprising an elongated hollow member of part-octagonal transverse cross-section having:

an elongated base wall, two elongated intermediate walls, two elongated side walls parallel to one another, two elongated flange walls coplanar with one another, and two elongated spaced returned walls parallel with one another;

respective longitudinal edges of the two intermediate walls having respective parallel junctions with the two horizontal edges of the base wall;

two respective longitudinal edges of the two parallel side walls having respective parallel junctions with the other two edges of the intermediate walls;

two respective longitudinal edges of the two coplanar flange walls having respective parallel junctions with the other two edges of the side walls, and two respective longitudinal edges of the two parallel returned walls having respective parallel junctions with the other two edges of the flange walls.

Also in accordance with this invention there is provided a panel element for a fence construction comprising:

a central elongated base wall, two elongated first stiffening walls having respective elongated edge junctions with the base wall, two elongated outwardly inclined intermediate walls having respective elongated edge junctions with the first stiffening walls, two elongated second stiffening walls having respective elongated edge junctions with the inclined intermediate walls, two elongated approximately coplanar intermediate walls having respective elongated edge junctions with the second stiffening walls, and two elongated inwardly inclined end walls having respective elongated edge junctions with the coplanar intermediate walls, the two first and the two second stiffening walls all being parallel to one another and at respective right angles to the base wall and the coplanar intermediate walls, and the free edges of the two end walls lying approximately in the same plane as the said base wall.

DESCRIPTION OF THE DRAWINGS

Fence constructions and fence elements for such constructions that are particular preferred embodiments of the invention will now be described, by way of example, with reference to the accompanying diagrammatic drawings wherein.

DESCRIPTION OF THE PREFERRED EMBODIMENTS

Figure 1:
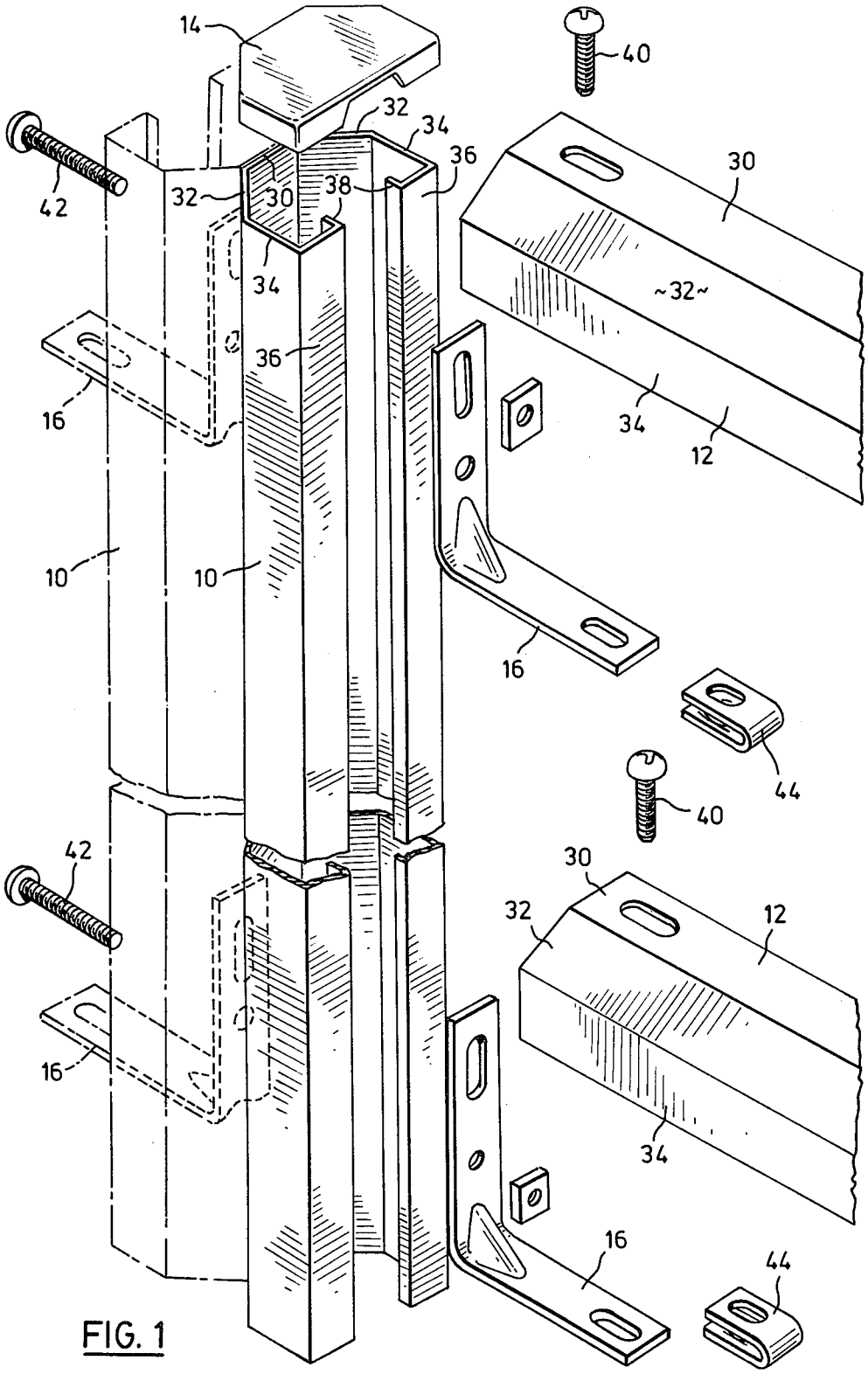
FIG. 1 is an exploded view illustrating a fence post and fence rail of the invention and the manner in which they can be connected to one another.
Figure 2:
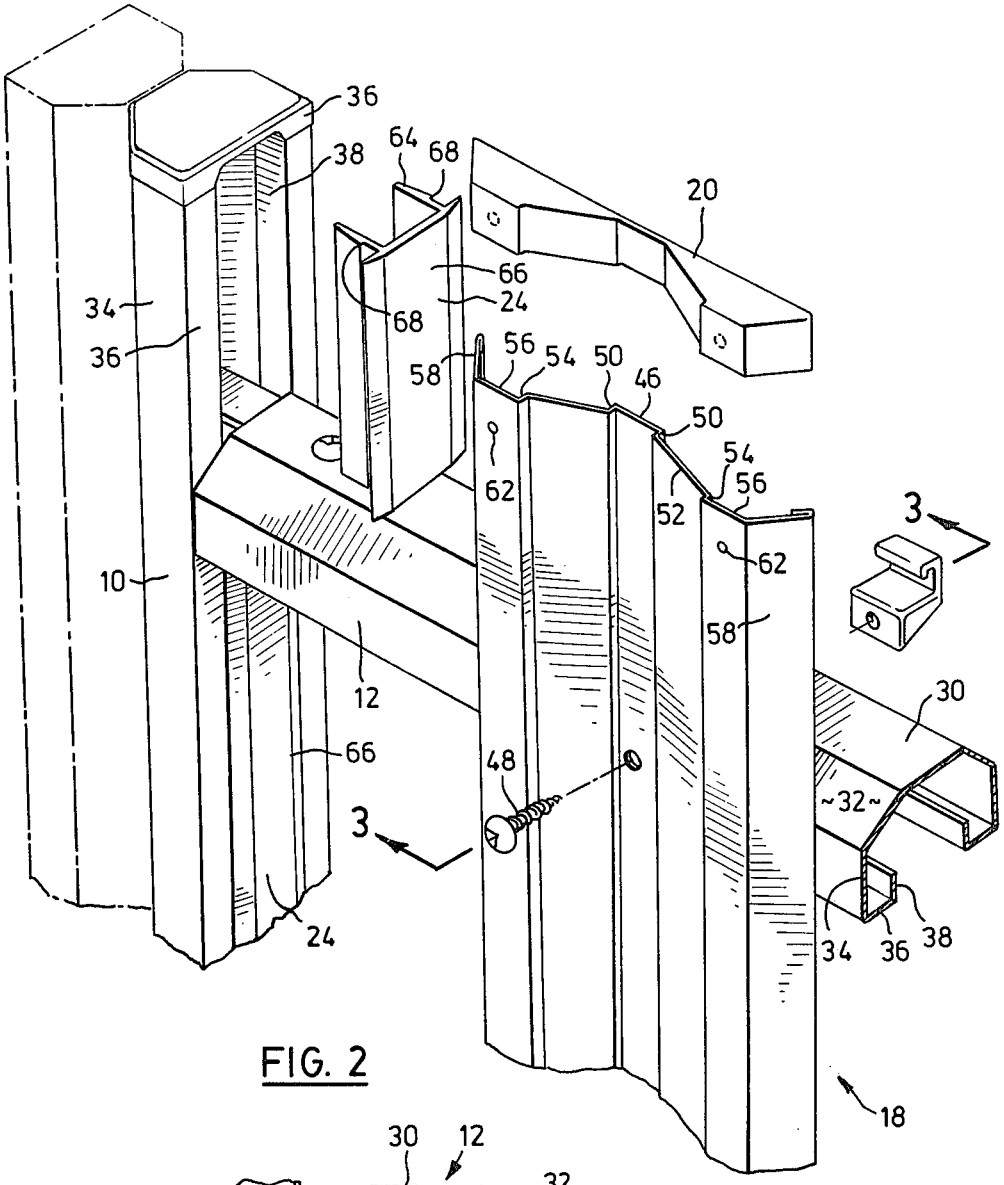
FIG. 2 is a partial exploded view illustrating particularly a fence panel and the manner in which it can be connected to a fence rail.
Figure 3:
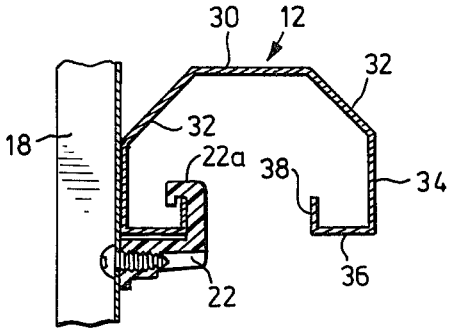
FIG. 3 is a section on the line 3—3 of FIG. 2.

All of the different fence constructions of the invention can be constructed employing the following elements, which will be described below in more detail:

(a) a post/rail element which when used as a post is given the reference 10, and when used as a rail is given the reference 12;

(b) an end cap 14 for the post elements 10;

(c) an L-shaped connecting bracket 16 for connecting posts 10 and rails 12;

(d) a panel element 18;

(e) an end cap 20 for the panel element;

(f) a clip 22 used for fastening a panel element to a rail;

(g) an unslotted side closure element 24 for closing the gap in one side wall of the post elements 10;

(h) a slotted closure element 26 for closing the gap in the lower side wall of an upper fence rail and for holding the upper end of a panel element;

(i) a slotted closure element 28 for closing the gap in the upper side wall of a lower fence rail and for holding the lower end of a panel element, and (j) various conventional fasteners that will be referred to as necessary.

Referring now especially to FIG. 1, a fundamental part of any fence construction is of course the fence post, and in the constructions of this invention this is provided by an element 10, which is used singly at the end of the fence, and in combination with another like post element at locations within the run of the fence. Each such post is of hollow part-octahedral transverse cross-section consisting of a flat elongated base wall 30, two flat elongated outwardly inclined intermediate walls 32, each joined with a 45° junction to a respective edge of the base wall, two flat elongated side walls 34, each joined with a 45° junction to a respective edge of the adjacent intermediate wall so that the side walls are parallel to one another, two flat elongated flange walls 36 each joined with a right angle junction to a respective edge of the side walls so that they are coplanar with one another, and two flat elongated spaced parallel returned walls 38, each joined with a right angle junction to a respective edge of the adjacent flange wall. The spacing between the two returned walls is slightly greater than the width of the base wall 30, but can be equal or slightly smaller.

Figure 9A:
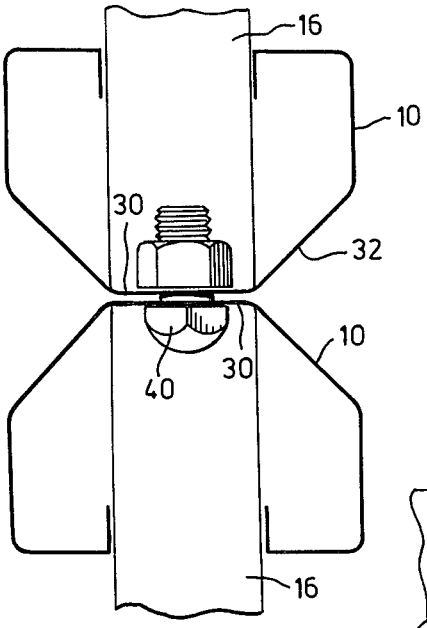
FIGS. 9*a* to 9*d* illustrate various ways of connecting together two post/rail elements of the invention to form straight and angled junctions in the fence construction.
Figure 9B:
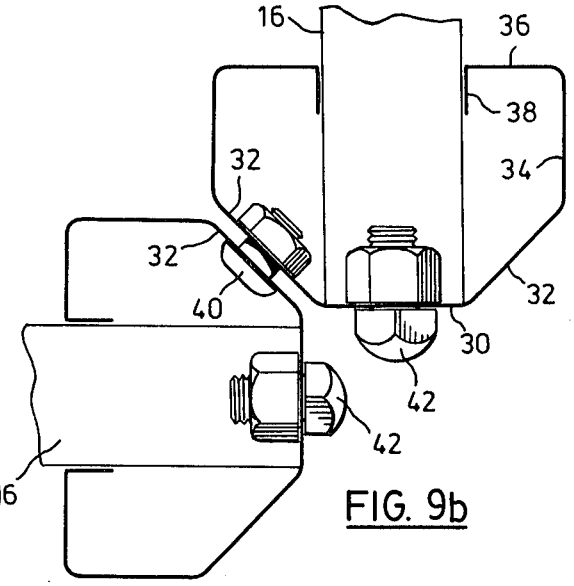
Figure 9C:
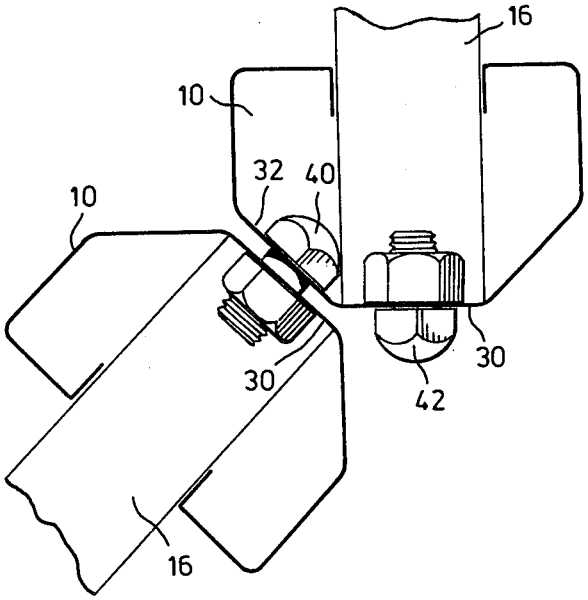
Figure 9D:
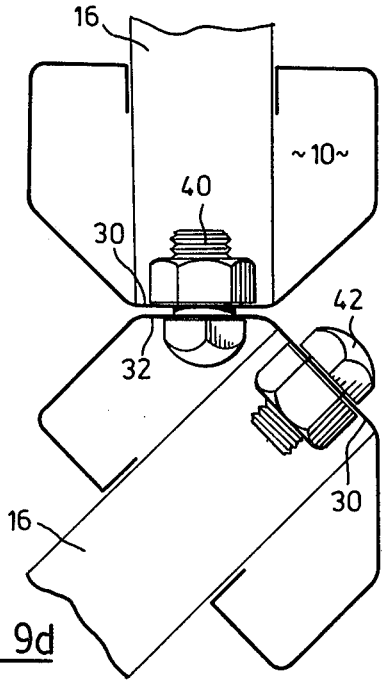

FIG. 9*a* illustrates the manner in which two of these elements are fastened together by bolt fasteners 40 through the two abutting base walls 30 to form a post interconnecting two straight runs of fencing. FIG. 9*b* shows a post providing a right angle junction with the fastener passing through two abutting intermediate walls 32, while FIGS. 9*c* and 9*d* show two different 45° junctions that are possible with one base wall 30 abutting an intermediate wall 32.

Figure 5:
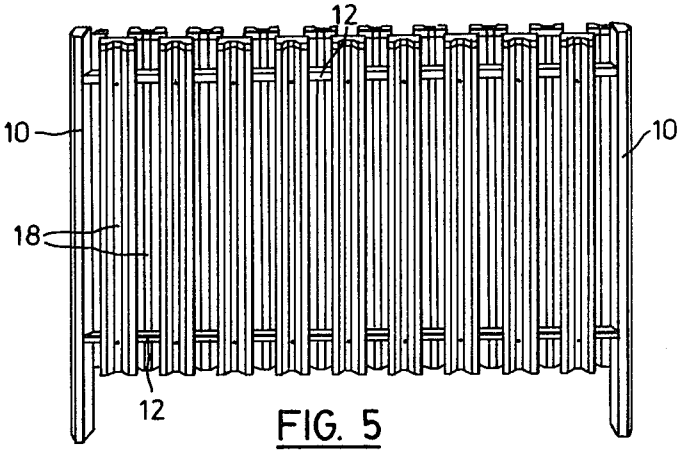
FIG. 5 is a front elevation of a perimeter fence employing overlapped panels on opposite sides of the horizontal rails.
Figure 7:
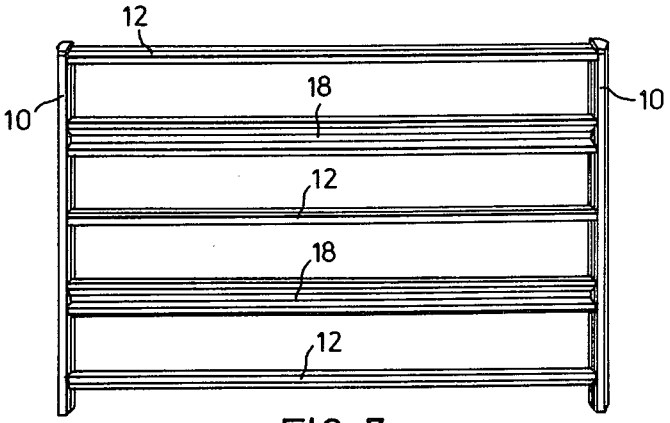
FIG. 7 is a front elevation of a boundary rail fence of the invention.
Figure 4:
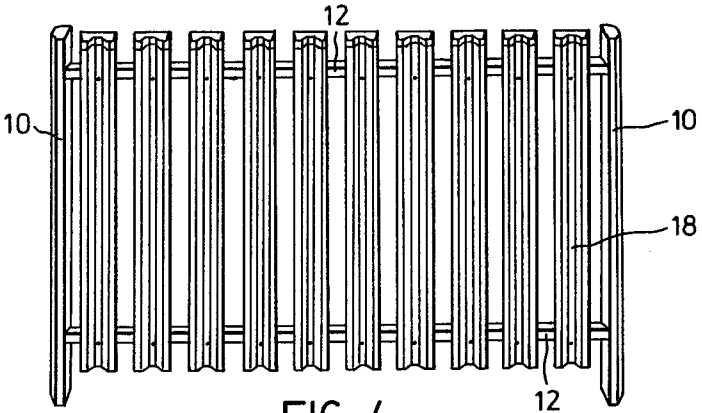
FIG. 4 is a front elevation of a perimeter fence of the invention employing spaced panels.
Figure 8:
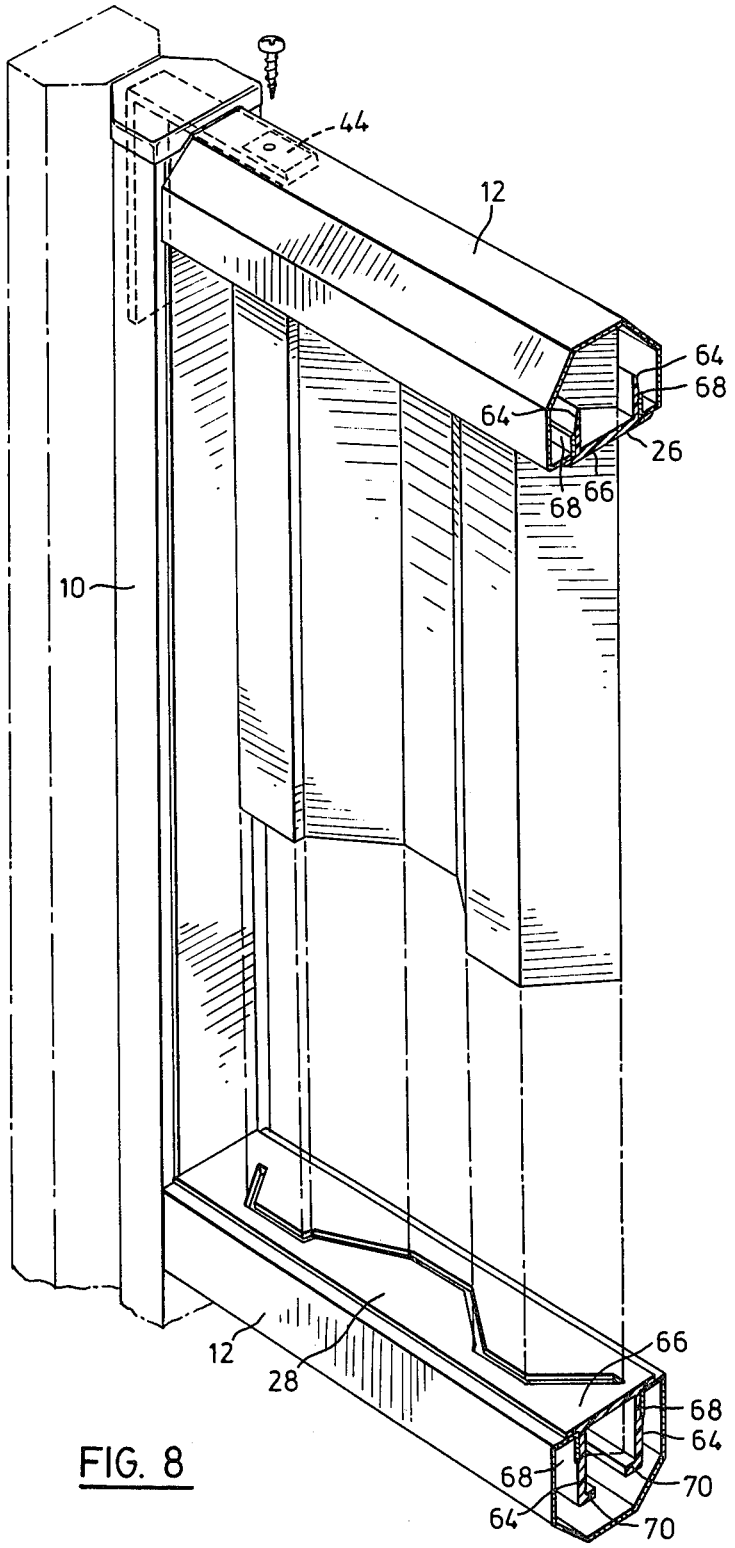
FIG. 8 is a vertical cross-section through the privacy fence of FIG. 6 to show its construction.

To form a rail-type boundary fence, such as that illustrated by FIG. 7, at least two vertically-spaced transverse rails 12 are fastened at each end to the respective post element via the L-shaped brackets 16, which are fastened to the post elements by bolts 42, or by bolts 40 if available, and to the rails 12 by bolts and speed-nuts 44. The relative positions of the fastening holes of the post elements and the brackets are made such that the upper bracket positioned as illustrated in FIG. 1 the rail is below the tops of the posts, as in the structures of FIGS. 4 and 5, while when positioned as illustrated in FIG. 8 the rail is at the top of the post, as in the structures of FIGS. 6 and 7. The top ends of the post elements are closed by the caps 14 which overlie the sheared metal edges and prevent entry of rain, etc. These caps are retained by the resilience of the post material which must be compressed slightly for the cap to be pushed thereon.

Referring now specifically to FIGS. 2, 3, 4 and 5, the last two figures show a type of perimeter fence in which a plurality of panel elements 18 are fastened to top and bottom horizontal rails 12. Each panel element consists of a centrally-disposed flat elongated base wall 46 which abuts against the respective wall 34 of the rail and receives a metal tapping screw 48, by which the panel is fastened to a plastic clip 22. It will be seen that the clip has a hook portion 22*a* that engages over the ledge formed by the walls 36 and 38 of the rail, the dimensions being such that the panel is held tightly against the rail.

The remainder of the panel is symmetrical about the base wall and consists of two narrow elongated first stiffening walls 50 having respective 90° elongated edge junctions with the base wall, two wider elongated outwardly-inclined intermediate walls 52 having respective approximately 90° elongated edge junctions with the first stiffening walls, two narrow elongated second stiffening walls 54 having respective approximately 90° elongated edge junctions with the walls 52, two wider elongated coplanar intermediate walls 56 having respective 90° elongated edge junctions with the stiffening walls 54, and two elongated inwardly-inclined end walls 58 having respective elongated edge junctions with the coplanar walls 56. The four spaced parallel stiffening walls 50 and 54 disposed adjacent the centre provide additional strength at the locations at which this is required to prevent buckling when the panel is under extreme load. The free edges of the walls 58 are returned to provide additional strength and rigidity, to hide the exposed edges and avoid possible damage to the public. The panel is shaped so that before installation these returned edges lie beyond the plane of the base wall 46, so that their engagement with the surface of the rail member as the screw 48 is tightened stresses the panel member against the rail to prevent rattling. The top end of each panel is in this fence construction provided with a snap-on end cap 20 to prevent damage to the panel end and also to the public. Each panel cap has on its interior surface two spigots 60 which snap into corresponding recesses 62 in the panel end.

The open faces of the posts may be closed by the plastic closure member 24, which has parallel side walls 64 adapted to fit closely between the parallel returned walls 38, and an end wall 66 that rests against the outside surface of the two post flange walls 36. The two side walls are provided with respective longitudinal ridges 68 which can engage behind the free edges of walls 38 to retain the closure member securely in place. In the fence construction of FIG. 4 the vertical panels are relatively widely spaced, while in the construction of FIG. 5 the spaces between adjacent panels on one side of the rails are closed by respective panels on the other side of the rails.

Figure 6:
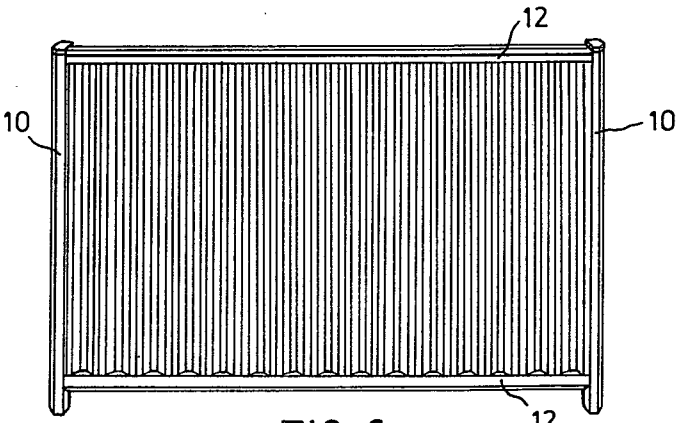
FIG. 6 is a front elevation of a privacy fence of the invention.

In the privacy fence construction of FIG. 6 the rails are mounted at their maximum distance apart permitted by the positioning of the brackets 16, and the ends of the panels 18 are engaged in the slot in the respective rail. This requires an upper rail closure member 26 and a lower rail closure member 28, which are seen in FIG. 8. It will be seen that the closure member 26 is essentially similar to the closure member 24, except that the wall 66 is provided with a punched-out slot corresponding to the profile of the panel 18, so that the panel end is held firmly. Similar parts of the bottom rail closure member 26 are given the same reference number, and it will be seen that it includes at the inside surfaces of the side walls 64 two inwardly extending coplanar flanges 70 on which the respective panel bottom edge rests to space it from the inside surface of the rail wall 30.

Preferably each portion of closure 26 or 28 receives only a single panel, so that they can be employed to space and locate the panels along the length of the fence construction. Moreover the panels can easily be reversed so that alternate panels face in opposite directions if desired. It will be seen that the top closure member only spaces the respective panel and retains it horizontally while the bottom closure member retains it both vertically and horizontally. Since the bottom edge of the panel rests on a plastic ledge water entrapment along the rail is prevented and any that enters the rail can drain to the ends and out.

The closure members 26 and 28 can also be used in the posts to hold panels 18 horizontally, as illustrated by the fence construction of FIG. 7. It will be seen that both the post/rail members and the panel members can readily be produced by continuous roll-forming from sheet metal to which protective and/or decorative coatings have previously been applied, the continuous strips thus formed then being cut to the required lengths and provided with the punched-out apertures, etc. that are required.

Figure 10:
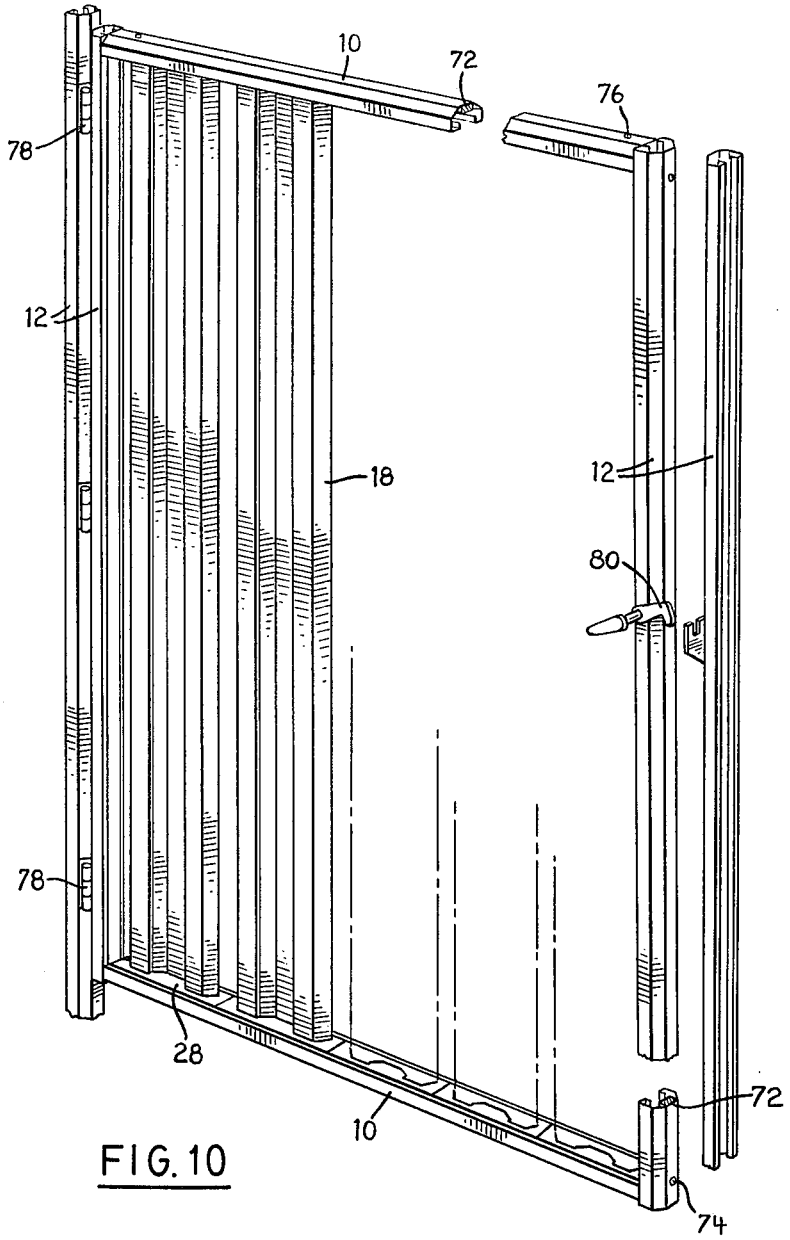
FIG. 10 is a perspective view of a gate structure for use in a fence of the invention and employing the post-/rail elements thereof.

The gate construction of FIG. 10 employs two upright posts 10 and two horizontal rails 12 of the required length, connected together by means of a rigid integral rectangular frame 72 fitting closely against the inside surfaces of the respective base walls 30; the posts being connected thereto by bolts 74 and the rails by bolts 76. The rectangular gate space between the rails and posts is closed by the required number of vertically-disposed panels 18. Two other vertical posts 10 respectively carry the hinges 78 and latch 80 for the gate.

We claim:

1. A post/rail element for a fence construction comprising an elongated hollow member of part-octagonal transverse cross-section having:

an elongated base wall, two elongated intermediate walls, two elongated side walls parallel to one another, two elongated flange walls coplanar with one another, and two elongated spaced returned walls parallel with one another;

respective longitudinal edges of the two intermediate walls having respective parallel junctions with the two longitudinal edges of the base wall;

two respective longitudinal edges of the two parallel side walls having respective parallel junctions with the other two edges of the intermediate walls;

two respective longitudinal edges of the two coplanar flange walls having respective parallel junctions with the other two edges of the side walls, and two respective longitudinal edges of the two parallel returned walls having respective parallel junctions with the other two edges of the flange walls.

2. A post/rail element as claimed in claim 1, wherein the distance between the said parallel spaced returned walls is equal to the transverse width of the base wall.

3. A post/rail element as claimed in claim 1, in combination with an end closure member of corresponding part-octagonal shape which fits over the post end and is retained thereon by the resilience of the material of the post element.

4. A post/rail element as claimed in claim 1, wherein the base wall has fastener-receiving apertures therein, and in combination with L-shaped brackets adapted to be fastened by such fasteners to the inside base wall surface and to protrude out between the parallel returned walls for fastening to another post/rail element extending at a right angle to the first-mentioned element.

5. A post/rail element as claimed in claim 1, in combination with an elongated side closure element having parallel side walls adapted to fit closely between the said parallel returned walls of an element and an end wall that, in position in a post/rail element, rests against the outside surfaces of the two flange walls.

6. A post/rail element as claimed in claim 5, wherein the said side closure element side walls have ridges engaging the free longitudinal edges of the returned walls to retain the closure element on the post/rail element.

7. A post/rail element as claimed in claim 5, wherein the said side closure element end wall is provided with elongated slots for the end-wise reception of a respective fence panel.

8. A post/rail element as claimed in claim 7, wherein an end closure element for use with a post/rail element that serves as a bottom rail is provided at the inside surfaces of its side walls with coplanar flanges on which the respective bottom panel edge rests to space it from the rail base inside surface.

9. A post/rail element as claimed in claim 1, in combination with a rigid integral rectangular frame to one side of which the element is fastened, three more post/rail elements fastened to the remaining sides of the frame to form a rectangular gate frame, a plurality of panel members extending between two opposite sides of the gate frame to close the gate space therebetween, hinges attached to one post element, and a latch member attached to the other post element.

10. A panel element for a fence construction comprising:

a central elongated base wall, two elongated first stiffening walls having respective elongated edge junctions with the base wall, two elongated outwardly inclined intermediate walls having respective elongated edge junctions with the first stiffening walls, two elongated second stiffening walls having respective elongated edge junctions with the inclined intermediate walls, two elongated approximately coplanar intermediate walls having respective elongated edge junctions with the second stiffening walls, and two elongated inwardly-inclined end walls having respective elongated edge junctions with the coplanar intermediate walls;

the two first and the two second stiffening walls all being parallel to one another and at respective right angles to the base wall and the coplanar intermediate walls, and the free edges of the two end walls lying approximately in the same plane as the said base wall.

11. A panel element as claimed in claim 10, wherein the said base wall is adapted for engagement with a surface of a rail member to which it is to be fastened and having fastener-receiving apertures therein.

12. A panel element as claimed in claim 11, wherein the free edges of the two end walls lie beyond the plane of the base wall, so that their engagement with the surface of the rail member to which it is fastened stresses the panel member to prevent rattling thereof.

13. A panel element as claimed in claim 11, in combination with an end cap member which fits over an end thereof with the panel end received therein.

14. A panel element as claimed in claim 11, wherein the free edges of the inclined end walls are returned to lie parallel to the remainder of the wall.

15. A panel element as claimed in claim 11, in combination with at least two spaced post/rail elements and at least two spaced elongated post/rail side closure elements, each said post/rail element comprising an elongated hollow member of part-octagonal transverse cross-section having:

an elongated base wall, two elongated intermediate walls, two elongated side walls parallel to one another, two elongated flange walls coplanar with one another, and two elongated spaced returned walls parallel with one another;

respective longitudinal edges of the two intermediate walls having respective parallel junctions with the two longitudinal edges of the base wall;

two respective longitudinal edges of the two parallel side walls having respective parallel junctions with the other two edges of the intermediate walls;

two respective longitudinal edges of the two coplanar flange walls having respective parallel junctions with the other two edges of the side walls, and two respective longitudinal edges of the two parallel returned walls having respective parallel junctions with the other two edges of the flange walls, each said side closure element having parallel side walls adapted to fit closely between the said parallel returned walls of a post/rail element and an end wall that, in position in a post/rail element, rests against the outside surfaces of the two flange walls, each said spaced side closure element receiving the respective end of a single panel element.

16. A panel element as claimed in claim 11, wherein the edge junctions between the first and second stiffening walls and the immediately adjacent walls are all about 90°.

17. A fence construction comprising at least two spaced parallel post elements, and at least two spaced parallel rail elements, each of said elements comprising:

an elongated base wall, two elongated intermediate walls, two elongated side walls parallel to one another, two elongated flange walls coplanar with one another, and two elongated spaced returned walls parallel with one another;

respective longitudinal edges of the two intermediate walls having respective parallel junctions with the two longitudinal edges of the base wall;

two respective longitudinal edges of the two parallel side walls having respective parallel junctions with the other two edges of the intermediate walls;

two respective longitudinal edges of the two coplanar flange walls having respective parallel junctions with the other two edges of the side walls, and two respective longitudinal edges of the two parallel returned walls having respective parallel junctions with the other two edges of the flange walls.

and a plurality of panel elements adopted to be disposed vertically and parallel to one another and to be fastened to two parallel vertically spaced rail elements, each panel element comprising:

a central elongated base wall, two elongated first stiffening walls having respective elongated edge junctions with the base wall, two elongated outwardly inclined intermediate walls having respective elongated edge junctions with the first stiffening walls, two elongated second stiffening walls having respective elongated edge junctions with the inclined intermediate walls, two elongated approximately coplanar intermediate walls having respective elongated edge junctions with the second stiffening walls, and two elongated inwardly-inclined end walls having respective elongated edge junctions with the coplanar intermediate walls;

the two first and the two second stiffening walls all being parallel to one another and at respective right angles to the base wall and the coplanar intermediate walls, and the free edges of the two end walls lying approximately in the same plane as the said base wall.

18. A fence construction as claimed in claim 17, in combination with an end closure member of corresponding part-octagonal shape which fits over the post end and is retained thereon by the resilience of the material of the post element.

19. A fence construction as claimed in claim 17, wherein the base wall of each post/rail element has fastener-receiving apertures therein, and in combination with L-shaped brackets adapted to be fastened by such fasteners to the inside base wall surface and to protrude out between the parallel returned walls for fastening to another post/rail element extending at a right angle to the first-mentioned element.

20. A fence construction as claimed in claim 17, in combination with an elongated side closure element having parallel side walls adapted to fit closely between the said parallel returned walls of an element and an end wall that, in position in a post/rail element, rests against the outside surfaces of the two flange walls.

21. A fence construction as claimed in claim 20, wherein the said side closure element side walls have ridges engaging the free longitudinal edges of the returned walls to retain the closure element on the post/rail element.

22. A fence construction as claimed in claim 17, wherein with each panel member the free edges of the two end walls lie beyond the plane of the base wall, so that their engagement with the surface of the rail member to which it is fastened stresses the panel member to prevent rattling thereof.

23. A fence construction as claimed in claim 17, wherein each panel member is provided with an end cap member which fits over an end thereof with the panel end received therein.

24. A fence construction comprising at least two spaced parallel post elements, and at least two spaced parallel rail elements, each of said elements comprising:

an elongated base wall, two elongated intermediate walls, two elongated side walls parallel to one another, two elongated flange walls coplanar with one another, and two elongated spaced returned walls parallel with one another;

respective longitudinal edges of the two intermediate walls having respective parallel junctions with the two longitudinal edges of the base wall;

two respective longitudinal edges of the two parallel side walls having respective parallel junctions with the other two edges of the intermediate walls;

two respective longitudinal edges of the two coplanar flange walls having respective parallel junctions with the other two edges of the side walls, and two respective longitudinal edges of the two parallel returned walls having respective parallel junctions with the other two edges of the flange walls;

and a plurality of panel elements adapted to extend parallel to one another with their opposite ends engaged in the channels of two opposite post/rail elements, each panel element comprising:

a central elongated base wall, two elongated first stiffening walls having respective elongated edge junctions with the base wall, two elongated outwardly inclined intermediate walls having respective elongated edge junctions with the first stiffening walls, two elongated second stiffening walls having respective elongated edge junctions with the inclined intermediate walls, two elongated approximately coplanar intermediate walls having respective elongated edge junctions with the second stiffening walls, and two elongated inwardly-inclined end walls having respective elongated edge junctions with the coplanar intermediate walls;

the two first and the two second stiffening walls all being parallel to one another and at respective right angles to the base wall and the coplanar intermediate walls, and the free edges of the two end walls lying approximately in the same plane as the said base wall.

25. A fence construction as claimed in claim 24, wherein each post/rail element is provided with an end closure member of corresponding part-octagonal shape which fits over the post end and is retained thereon by the resilience of the material of the post element.

26. A fence construction as claimed in claim 24, wherein the base wall of each post/rail element has fastener-receiving apertures therein, and in combination with L-shaped brackets adapted to be fastened by such fasteners to the inside base wall surface and to protrude out between the parallel returned walls for fastening to another post/rail element extending at a right angle to the first-mentioned element.

27. A fence construction as claimed in claim 24, in combination with an elongated side closure element having parallel side walls adapted to fit closely between the said parallel returned walls of an element and an end wall that, in position in a post/rail element, rests against the outside surfaces of the two flange walls.

28. A fence construction as claimed in claim 27, wherein the said side closure element side walls have ridges engaging the free longitudinal edges of the returned walls to retain the closure element on the post-/rail element.

29. A fence construction as claimed in claim 27, wherein the said side closure element end wall is provided with elongated slots for the end-wise reception of a respective fence panel.

30. A fence construction as claimed in claim 29, wherein an end closure element for use with a post/rail element that serves as a bottom rail is provided at the inside surfaces of its side walls with coplanar flanges on which the respective bottom panel edge rests to space it from the rail base inside surface.

31. A fence construction as claimed in claim 29, wherein each closure element receives the end of a single respective panel element.

* * * * *